US006501349B2

(12) United States Patent
Jokilehto et al.

(10) Patent No.: US 6,501,349 B2
(45) Date of Patent: Dec. 31, 2002

(54) METHOD AND ARRANGEMENT FOR FASTENING INNER CONDUCTOR OF RESONATOR STRUCTURE

(75) Inventors: Pekka Antero Jokilehto, Oulu (FI); Tapio Juha Kaarlo Suvanto, Liminka (FI); Teuvo Juhani Haapalahti, Oulunsalo (FI)

(73) Assignee: Remec OY, Oulu (FI)

( * ) Notice: Subject to any disclaimer, the term of this patent is extended or adjusted under 35 U.S.C. 154(b) by 0 days.

(21) Appl. No.: 09/727,936

(22) Filed: Dec. 1, 2000

(65) Prior Publication Data

US 2001/0002810 A1 Jun. 7, 2001

(30) Foreign Application Priority Data

Dec. 1, 1999 (FI) ..... 19992580

(51) Int. Cl.[7] ..... H01P 7/04
(52) U.S. Cl. ..... 333/222; 333/206
(58) Field of Search ..... 333/206, 203, 333/222

(56) References Cited

U.S. PATENT DOCUMENTS 6,114,928 A * 9/2000 Smith ..... 333/202

FOREIGN PATENT DOCUMENTS

| | | |
|---|---|---|
| EP | 0533394 A2 * | 3/1993 |
| EP | 0825665 | 2/1998 |
| EP | 0924790 | 6/1999 |
| FI | 89115 | 4/1993 |
| JP | 8195607 | 7/1996 |
| NL | 106836 | 11/1963 |

* cited by examiner

*Primary Examiner*—Robert Pascal
*Assistant Examiner*—Stephen E. Jones
(74) *Attorney, Agent, or Firm*—Ladas & Parry

(57) ABSTRACT

The invention relates to an arrangement for fastening an inner conductor of a resonator structure and to a method for fastening an inner conductor of a resonator structure to a fastening surface structure. The arrangement comprises a fastening surface structure, which in turn comprises an edge of an opening and the opening defined by the edge, the opening being formed through the fastening surface structure. In addition, the arrangement comprises an inner conductor of a resonator structure arranged at the opening formed through the fastening surface structure, the inner conductor comprising an inner space at least on the portion of the conductor that faces the fastening surface structure, which inner space is defined by the wall of the inner conductor which extends into the opening formed through the fastening surface structure. According to the invention, the fastening arrangement comprises an expander, springy in the radial direction, which is brought and thereby fastened in place into the inner space of the inner conductor placed in the opening in the fastening surface structure, the expander being used for pressing the wall of the inner conductor surrounding the inner space of the inner conductor against the edge of the opening formed through the fastening surface structure, at least on the portion of the opening area where the wall surrounding the inner space of the inner conductor coincides with the edge of the opening formed through the fastening surface structure.

10 Claims, 4 Drawing Sheets

METHOD AND ARRANGEMENT FOR FASTENING INNER CONDUCTOR OF RESONATOR STRUCTURE

The invention relates to an arrangement for fastening an inner conductor of a resonator structure, the arrangement comprising a fastening surface structure comprising an edge of an opening and an opening defined by the edge, the opening being formed through the fastening surface structure, and an inner conductor of a resonator structure at the opening formed through the fastening surface structure, the inner conductor comprising an inner space at least in the portion facing the fastening surface structure, which inner space is defined by the wall of the inner conductor, the wall extending into the opening formed through the fastening surface structure The invention further relates to a method for fastening an inner conductor of a resonator structure.

Resonator structures employed in high frequency areas, particularly in radio frequency areas, are used for example at base stations of mobile networks. Filters can be used for example as interface circuits and filter circuits in amplifiers of base station transmitter or receiver units.

In the resonator structures the inner conductor of the resonator is fastened to a fastening surface, which is in practice usually the end, such as a bottom or a cover, of a housing structure serving as the outer conductor of the resonator structure. In other words, the inner conductor is short-circuited to the fastening surface, i.e. in practice to the outer conductor. The short-circuited end of the inner conductor, i.e. the end where the inner conductor is short-circuited to the outer conductor, is also called an inductive end, because signal connection takes place inductively. At the other end of the inner conductor, the inner conductor is galvanically isolated from the outer conductor, the other end thus being what is known as a free end of the inner conductor. The free end of the inner conductor is also called its capacitive end, because signal connection takes place capacitively. The outer conductor and the inner conductor inside the compartment it forms together build a resonance circuit. In practice resonator structures are often multi-circuit structures, i.e. the resonator structure comprises a plural number of inner conductor and outer conductor pairs, each compartment formed of an outer conductor having a separate inner conductor. The resonance circuits of a multi-circuit resonator structure together provide the resonator structure with a desired frequency response.

In a prior art solution the inner conductor is fastened to the fastening surface by means of a screw or a bolt. To ensure that the joint between the inner conductor and the fastening surface is tight enough so that problems related to intermodulation are avoided, the solution has to be provided with a weld at the seam between the inner conductor and the fastening surface, i.e. at the foot of the inner conductor. The weld requires that the entire structure is heated in an oven to an elevated temperature, e.g. to 210 degrees Celsius, so it is apparent that the solution is inconvenient and expensive.

Another solution is provided using a riveting tool. The riveting is carried out by hitting the fastening surface around the opening of the fastening surface with the tool at the lower end of the inner conductor to make the material of the fastening surface at the opening squeeze the inner conductor. The problems related to this solution are similar to those described above.

Prior art also knows another riveting-type solution where a spreading tool is used for hitting the inner space of the inner conductor arranged into the opening of the fastening surface, thus causing the inner conductor wall placed in the opening to widen in the lateral direction. This kind of riveting solution does not, however, provide a permanently tight joint, because after the inner conductor wall has been hit with the spreading tool, there is no pressure left to prevent the radial return motion of the wall. The solution is therefore deficient with regard to the prevention of intermodulation and to the strength of the structure, and therefore a weld has to be used.

Fl publication 89115 teaches a structure, shown in FIG. 6 of the publication, where the inner conductor is fastened to an opening formed through the fastening surface with a solid, non-springy insertion piece, the lower edges of the inner conductor being thereby bent against the bottom of the fastening surface. A drawback of the structure is that the insertion piece is solid and non-springy, and therefore the fastening achieved is deficient, particularly with regard to the tightness required to allow intermodulation to be prevented.

An object of the present invention is to provide an arrangement for fastening an inner conductor of a resonator structure in a manner that offers a cost-effective, rapid and convenient means for accomplishing a tight joint with regard to intermodulation and provides a most solid structure by employing, however, a separate inner conductor that is easy to dimension precisely and the surface of which can be made very smooth, the inner conductor being, as stated, fastened to another separate piece, i.e. a fastening surface structure. The dimensional precision of the inner conductor with regard to the smoothness of its surface and its cross-sectional form has, as is well known, a great impact on the characteristics of a resonator structure.

The above stated object is achieved with a fastening arrangement of the invention, wherein the fastening arrangement comprises an expander, springy in the radial direction, which is brought and thereby fastened in place into the inner space of the inner conductor placed into the opening formed through the fastening structure, the expander being used for pressing the inner conductor wall surrounding the inner space of the inner conductor in a radial direction against the edge of the opening formed through the fastening structure at least on the portion of the opening area where the wall surrounding the inner space of the inner conductor coincides with the edge of the opening formed through the fastening surface structure.

A corresponding object is achieved with a method of the invention for fastening an inner conductor, wherein the inner conductor is fastened at an opening in the fastening surface structure by inserting an expander, which is springy in the radial direction, into an inner space of the inner conductor positioned at the opening in the fastening surface structure, the expander being used for pressing the inner conductor wall surrounding the inner space of the inner conductor in a radial direction against the edge of the opening formed through the fastening surface structure at least on the portion of the opening area where the wall surrounding the inner space of the inner conductor coincides with the edge of the opening formed through the fastening surface structure.

The solution of the invention provides a number of advantages. Thanks to the invention, welding or other additional sealing providing intermodulation between the lower end of the inner conductor and the fastening surface, such as the end of the housing structure of the resonator structure, are no longer needed. The end is for example the bottom or the cover of the housing. The solution of the invention alleviates problems related to intermodulation. The preferred embodiments of the invention and other more detailed applications thereof further emphasise the advantages of the invention. In addition, the manufacture of the invention is rapid and can be easily automated.

In the following the invention will be described in greater detail with reference to the accompanying drawings, in which FIG. 1 illustrates a first phase of a fastening arrangement in which the parts are still detached from one another;

Figure 7:
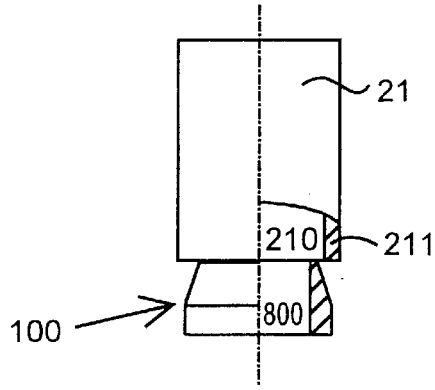
FIG. 7 illustrates an expander detachably fastened to the lower end of the inner conductor.
Figure 8:
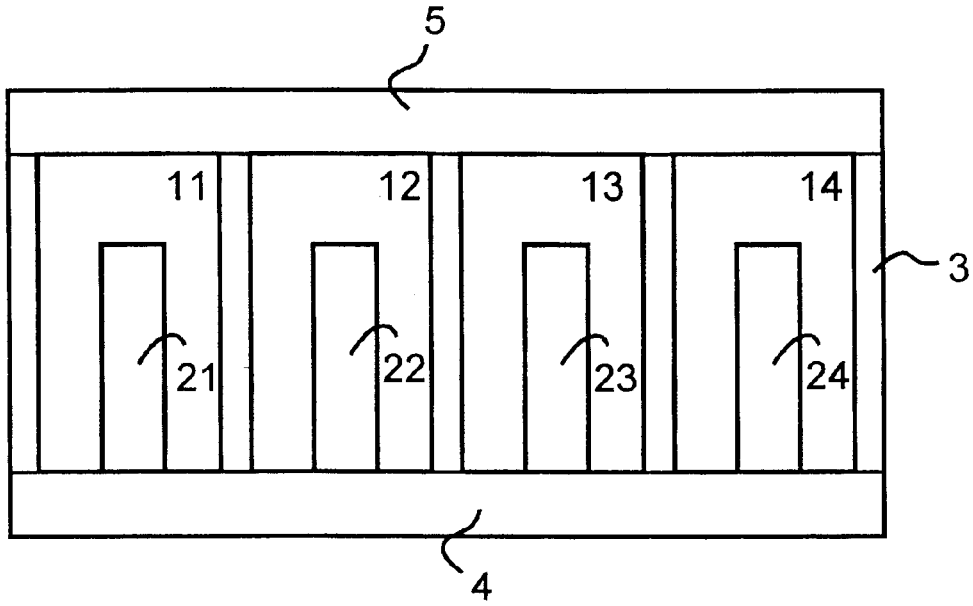
FIG. 8 is a schematic side view of a resonator structure.

With reference to the Figures, and to FIGS. 7 and 8 in particular, it is stated that the disclosure relates to a filter 1 comprising a housing structure 2, which in turn comprises a wall structure 3 and ends 4 and 5, end 4 providing the bottom 4 and end 5 the cover. The wall structure 3 and the ends 4–5 form at least one compartment into the housing structure 2; the present example comprising four compartments 11–14. In addition, the filter 1 comprises at least one resonator, i.e. an inner conductor; the present example comprising four inner conductors 21–24 arranged into the compartments 11–14 of the housing structure 2. The bottom 4 of the housing structure 2 refers to that side of the housing structure 2 to which the resonators are fastened, and thus also short-circuited. End 4 provides a fastening surface structure for the inner conductors. End 4 provides a fastening surface structure. References 3*a* , 3*b* and 3*d* denote the walls of the wall structure of the housing.

The invention relates to the fastening of the inner conductors 21–24 to the fastening surface structure 4. In the following, the invention will be described with reference to arrows 1–7, using the inner conductor 21 in particular as an example.

Figure 9:
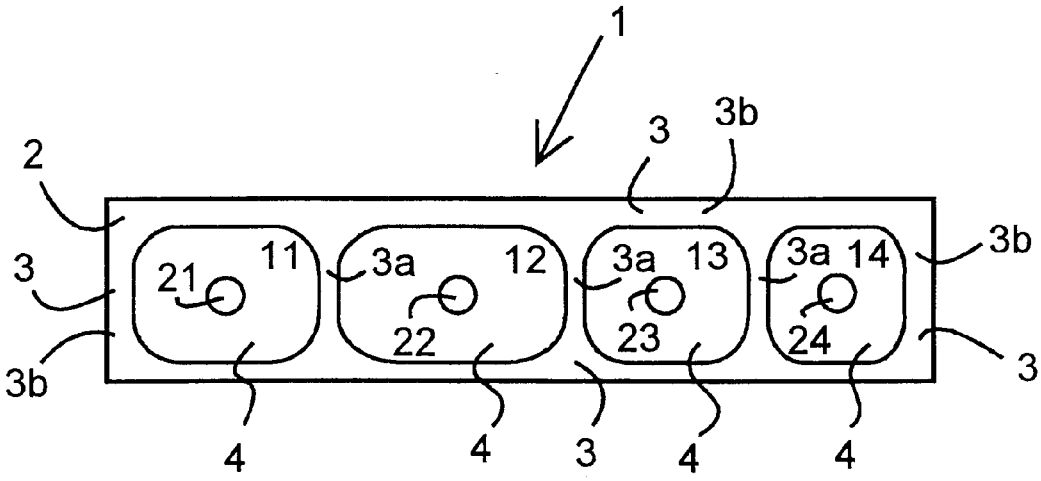
FIG. 9 is a schematic top view of a resonator structure, seen from underneath a cover end into the direction of a bottom end.

In the Figures, the inner conductor 21, for example, and the outer conductor surrounding it, i.e. the walls of the compartment 21, together form a resonator structure, a plural number of similar resonator structures together forming a resonator structure entity 1 as shown in FIGS. 8–9. The resonator structure entity is preferably a filter.

The fastening arrangement of the inner conductor, such as inner conductor 21, comprises a fastening surface structure 4, which in turn comprises an edge 51 of an opening and an opening 52 defined by the edge 51 of the opening, the opening being formed through the fastening surface structure 4. In addition, the fastening arrangement comprises a piece to be fastened, i.e. the inner conductor 21, positioned at the opening 52 formed through the fastening surface structure 4 and extending into the opening 52. The inner conductor 21 comprises, in turn, an inner space 210 at least at its portion facing the fastening surface structure, the inner space being defined by a wall 211 comprised by the inner conductor 21, the wall extending into the opening 52 formed through the fastening surface structure 4. The inner space 210 does not necessarily need to be provided in other parts of the inner conductor 21 than in the part where the inner conductor is in the opening 52 of the fastening surface structure. The fastening arrangement comprises an expander 100 brought and thereby fastened in place into the inner space 210 of the inner conductor 21 placed in the opening 52 formed through the fastening surface structure 4, the expander being used for pressing the wall 211 of the inner conductor 21 surrounding the inner space 210 in the inner conductor in a radial direction against the edge 51 of the opening 52 formed through the fastening surface structure 4 at least on the portion of the longitudinal area of the opening 52 where the wall 211 surrounding the inner space 210 of the inner conductor 21 coincides with the edge 51 of the opening 52 formed through the fastening surface structure 4.

Figure 2:
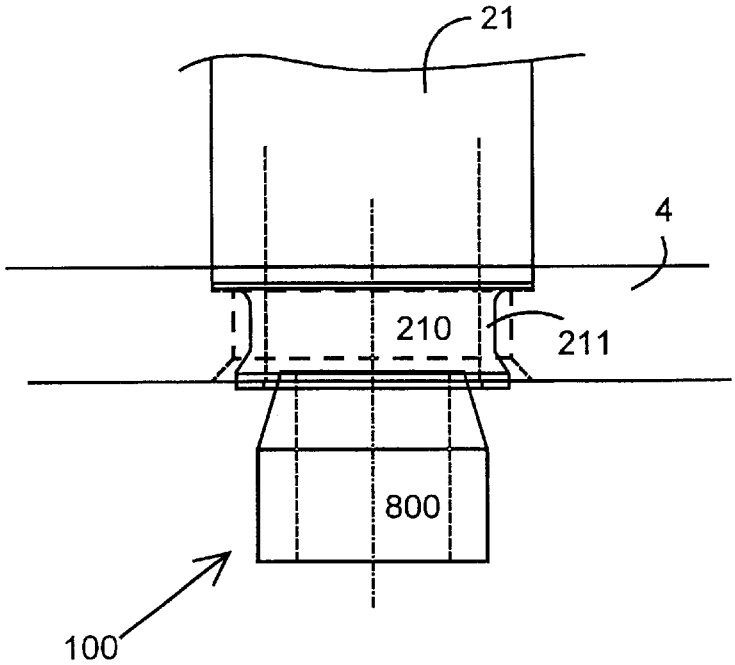
FIG. 2 illustrates a fastening arrangement with an inner conductor already positioned into an opening in the fastening arrangement.
Figure 3:
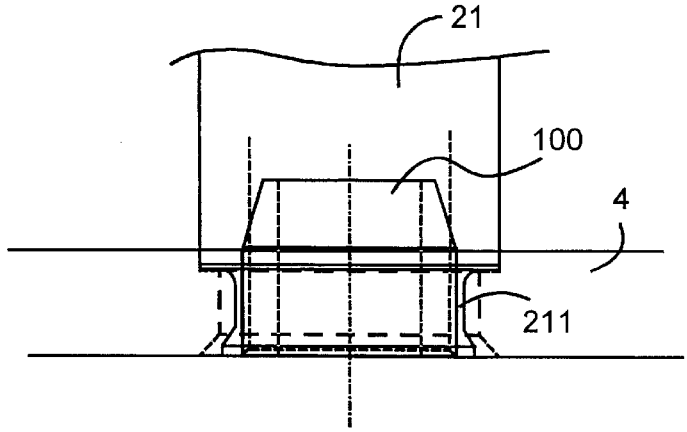
FIG. 3 illustrates a fastening arrangement with an expander already inserted into an inner space of the inner conductor.

In an arrangement according to a preferred embodiment, the pressing is provided by arranging at least one area where the pressure is high, whereas in other areas it is lower, or there is no contact at all to the wall of the inner conductor. An area in this context refers to a annular area. This allows a local pressing force to be exerted on a small area, instead of providing a uniform pressure in the entire area of the opening 52 formed through the fastening surface structure 4, which would not be sufficiently strong. In other words, the arrangement according to the preferred embodiment in question is such that the wall 211 of inner conductor 21 surrounding the inner space 210 of the inner conductor 21 is pressed against the edge 51 of the opening formed through the fastening surface structure 4 only in the portion of the opening area where the wall 211 surrounding the inner space 210 of the inner conductor 21 coincides with the edge of the opening formed through the fastening surface structure. Since the compartment chamber of the resonance circuit 21, 11 is located in the same place as the inner conductor 21, the arrangement according to the preferred embodiment is such that the wall 211 of the inner conductor 21 surrounding the inner space 210 is pressed with the expander 100 against the edge 51 of the opening 52 formed through the fastening surface structure 4 on the side of the fastening surface 4 facing the inner conductor 21. In addition to the area 301 referred to, the other side can also be sealed in the preferred embodiment, a second area 302 where the wall of the inner conductor 21 surrounding the inner space 210 of the inner conductor is pressed with the expander 100 against the edge of the opening formed through the wall of the fastening surface structure then being on the opposite edge of the fastening surface structure with regard to the inner conductor. The above two-sided pressure sealing provides further improved tightness. As stated above, the pressure areas 301, 302, such as the two presented above, are annular areas caused by the impact of the expander 100 on the wall 211 of the inner conductor 21 and further from the wall 211 of the inner conductor 21 to the edge 51 of the opening 52 in the fastening surface structure 4 and still further to the area of the fastening surface structure surrounding the edge of the opening. In the arrangement of FIG. 2, which shows the situation prevailing before the expander is brought in place, there are one or more points 401, 402 where the distance between the edge of the opening and the inner conductor wall is shorter than elsewhere, the distance thus being greater in other parts. The annular pressure areas 301, 302 referred to above are thus formed at the locations of these points 401, 402 where the distance is the shortest. The distance at these sections may be only just enough to allow the wall 211 to be fitted to the opening of the fastening surface, i.e. the distance may be equal to a minimal clearance, such as 10 micrometers, whereas in the mid-area of the opening, in its longitudinal direction, the distance may be as much as one millimeter because that area does not necessarily need to be pressed tightly at all. Consequently, there are one or more points 450 where the distance between the edge 51 of the opening in the fastening structure and the wall 210 of the inner conductor 21 is greater than elsewhere and thus the edge 51 of the opening and the wall 211 of the inner conductor 21 remain at a distance from each other even after the expander has been forced in place, as shown in FIGS. 3, 4A, 4B, or at least the pressing force at these points is lower than at the points 401, 402 where the distance between the edge of the opening and the wall of the inner conductor is shorter already before the expander is inserted.

Figure 4A:
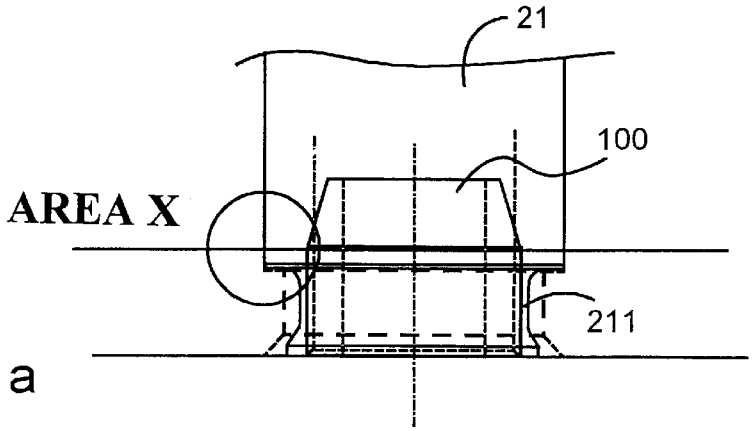
FIG. 4A illustrates the situation of FIG. 3, added with a circle denoting a deformation area.
Figure 4B:
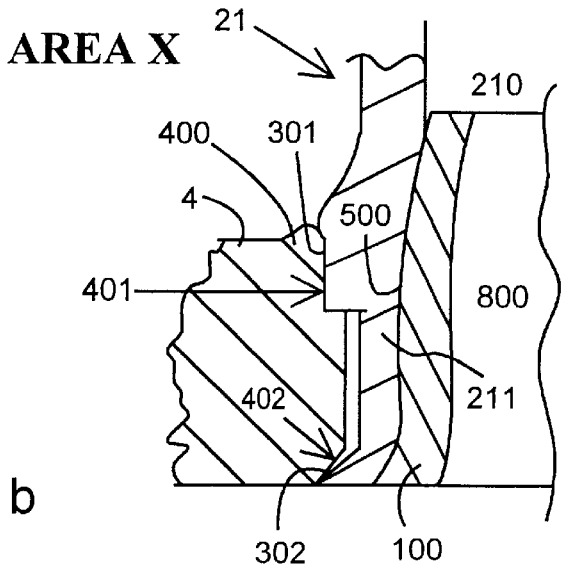
FIG. 4B illustrates a partial enlargement of FIG. 4A.
Figure 5:
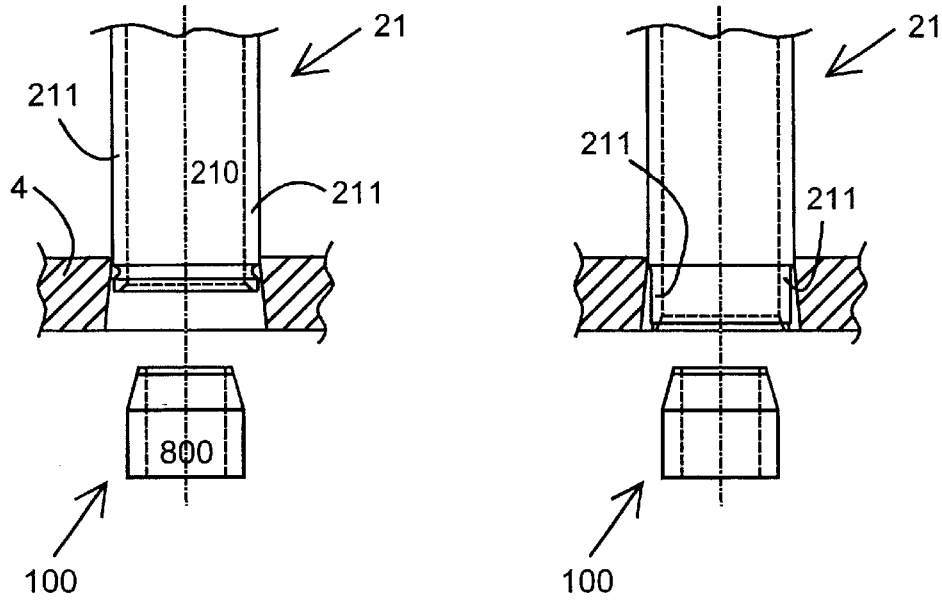
FIG. 5 illustrates a version where the opening in the fastening surface structure is conical.

With reference to FIGS. 4A and 4B in particular, it is stated that the diameter of the expander 100, the diameter of the inner space 210 of the inner conductor 21, the outer diameter of the wall 211 surrounding the inner space 210 of the inner conductor 21, and the diameter of the opening 52 formed through the fastening surface structure 4 are selected so that by pressing the wall 211 surrounding the inner space 210 of the inner conductor 21 against the edge 51 of the opening 52 of the fastening surface structure 4 the expander 100 brought in place causes a deformation 400 on the area surrounding the edge of the opening of the fastening surface structure 4.

Since the pressure provided by the expander first acts on the wall 211 of the inner conductor 21, in the preferred embodiment the diameter of the expander 100, the diameter of the inner space 210 of the inner conductor 21, the outer diameter of the wall 211 surrounding the inner space of the inner conductor 21, and the diameter of the opening 52 formed through the fastening surface structure 4 are selected so that by pressing the wall 211 surrounding the inner space 210 of the inner conductor 21 against the edge of the opening of the fastening surface structure the expander 100 brought in place causes a deformation 500 on the wall of the inner conductor surrounding the inner space of the inner conductor.

A general statement relating to one or both of the above deformations 400, 500, is that when brought in place, the expander forms a deformation area on a section of the joint between the wall surrounding the inner space of the inner conductor and the edge of the opening in the fastening surface structure, the section being on the same side of the fastening surface in the fastening arrangement as the inner conductor. This kind of deformation provides an excellent tightness for preventing intermodulation.

With regard to the deformations, particularly the deformation 400 caused on the fastening surface structure, it is stated that the deformation 400 does not necessarily have to be a detectable protrusion 400, although a protrusion provides better tightness and allows the fastening achieved to be better verified.

A prerequisite for the pressure and the deformation is tension. For this reason, in the preferred arrangement the diameter of the expander 100 and that of the inner space 210 of the inner conductor 21 are selected so that when brought in place, the expander causes a tension between the expander 100 and the wall of the inner space of the inner conductor. Correspondingly, the outer diameter of the wall 211 surrounding the inner space 210 of the inner conductor 21 and the diameter of the opening 52 formed through the fastening surface structure 4 are selected in the preferred embodiment so that when brought in place, the expander 100 causes a tension between the outer surface of the wall 211 surrounding the inner space 210 of the inner conductor 21 and the opening formed through the fastening surface structure 4.

A preferred expander comprises a narrowing bevel 600. The bevel facilitates mounting and enhances pressure. The surface of the expander is thus preferably conical. The conical shape preferably comprises two portions, i.e. on the outer surface of the expander 100 there is a guide bevel 700 at least the tip of which is narrower than the diameter of the inner space of the inner conductor, the slope of the guide bevel being selected to be between 5 and 45 degrees. The slope of the narrowing bevel is selected to be between 0.5 and 5 degrees.

The expander 100 is springy in the radial direction so that when brought in place it causes a tension but does not damage the area surrounding it. The expander preferably comprises a longitudinal through hole 800, i.e. the expander is sleeve-like and thus springy. The thickness of the expander wall with regard to the outer diameter of the expander must be small, for example 5–10% of the outer diameter of the expander. The expander 100 comprises an outer surface through which the expander 100 presses the inner conductor wall defining the inner space of the inner conductor against the edge 51 of the opening 52 in the fastening surface structure. With regard to the sleeve-like expander, it is stated that to make the expander springy in the radial direction, the expander thus comprises a annularwall and a longitudinal through hole 800 defined by the annularwall, the expander thereby having a sleeve-like form. It is also stated that the invention incorporates the principle that to make the expander springy in the radial direction, it comprises a annularwall and an inner space 800 defined by the annularexpander wall. In other words, the structure of the expander may as described above, i.e. it may be a sleeve-like structure, due to the through hole, or the structure may be closed at one end of the inner space 800. In the latter case, where one end of the expander would be closed, the inner space 800 formed would be nest-like. If a solution is chosen where one end of the expander is closed, then the expander is preferably closed at the end that is lower in the Figures, the closed end thus closing the opening in the fastening surface and the resonator opening therein.

To ensure efficient space utilization, the lower end of the resonator does not extend out of the opening in the fastening surface, which is one of the drawbacks of a prior art structure.

Let us then discuss the invention when applied as a method for fastening an inner conductor, such as inner conductor 21, of a resonator structure. The method involves fastening the inner conductor 21 of the resonator structure to the fastening surface structure 4.

The inner conductor 21 is fastened at the opening 52 in the fastening surface structure 4 by inserting an expander 4, which is springy in the radial direction, into the inner space 210 of the inner conductor 21 positioned at the opening in the fastening surface structure 4, the expander being used for pressing the wall 211 of the inner conductor 21 surrounding the inner space 210 of the inner conductor 21 against the edge 51 of the opening 52 formed through the fastening surface structure 4 at least on the portion of the opening area where the wall 211 surrounding the inner space 210 of the inner conductor 21 coincides with the edge 51 of the opening 52 formed through the fastening surface structure 4.

The expander is preferably used in the method for producing a deformation on the wall 211 of the inner conductor. Correspondingly, the expander 100 is preferably used for producing a deformation through the inner conductor wall on the area surrounding the opening in the fastening surface structure. The expander is used for causing a tension between the expander and the inner conductor wall, and between the inner conductor wall and the edge of the opening in the fastening surface structure. The mounting and dimensioning of the elements involved in the method are preferably such that the expander is specifically forced in place into the inner space 211 of the inner conductor in the area of the opening 52 in the fastening surface structure 4. The applicant considers this to be a good method because no subsequent measures are required. An alternative is to simply insert the expander 100 somehow into the inner space of the inner conductor 21 and then provide a pressure between the expander and the wall surrounding the inner space of the inner conductor by applying for example thermal treatment, or some other method.

The examples shown in the Figures illustrate a preferred version where the expander 100 is inserted into the inner space of the inner conductor from the opposite direction with regard to the direction from which the inner conductor 21 is positioned at the opening 52 of the fastening surface structure 4. The applicant considers the method in question to be a good one, although in some embodiments and applications the expander can also be inserted from the same direction as the inner conductor, i.e. one alternative would be to insert the expander from the open free end of the inner conductor into the inner space of the inner conductor and further towards the fastening surface 4.

If the expander is forced into the inner space of the inner conductor, then the diameter of the expander 100 is preferably 3–15% greater than the diameter of the inner space of the inner conductor. According to an example, the diameter of the expander is 0.3 mm greater than the diameter of the inner space of the inner conductor. In another example an inner conductor which is 10 mm thick has an inner space the diameter of which is 8 mm. In this case, the diameter of the expander 100 might be for example 1 mm greater than that of the inner space.

The inner conductor is placed into the opening in the base plate, and the sleeve is gradually pressed into the hollow inner conductor from underneath the plate. The sleeve compresses slightly in the radial direction, and the inner conductor tube gives way in the radial direction. In the end, when the sleeve is pressed for example to the level of the inner conductor end/the plate surface, a radial pressing force is provided at the upper junction interface against the edge of the opening in the plate, thereby causing the root to be sealed.

The term 'inner conductor' refers not only to the actual inner conductor, such as 21–24, but also to an inner conductor 25 of FIGS. 8–9 which is in the vicinity of the actual inner conductor and galvanically connected to a signal input, such as an RX or TX coupling unit, or galvanically connected to a signal output, such as an antenna coupling unit. This type of inner conductor, which is called a tenoned resonator, is used either for supplying a signal for example to the first resonance circuit of a resonance structure or for forwarding a filtered signal onward for example from the last resonance circuit in a resonance structure.

The process is question is preferably specifically forcing, i.e. the outer diameter of the expander is greater than the diameter of the inner space of the inner conductor. Alternatively, the embodiment in question may be one where prior to the final work phase, the outer diameter of the expander is greater than the diameter of the inner space of the inner conductor. The expander is first loose and can therefore be inserted into the inner space of the conductor without resistance, the expander being then expanded by applying thermal treatment, for example, or some other means.

The expander may be made of one or more parts. If the expander is made of two parts, then the parts of the expander may be either partially or entirely one inside the other. The second part of the expander may be used for expanding the first, outer part in the radial direction to allow the outer expander part to expand the inner conductor wall surrounding it towards the opening in the fastening surface. The resonator structure of the invention, i.e. preferably a filter, can be used for example in radio transmitters, receivers or in transceivers, such as base stations of cellular radio networks. In such cases it is apparent that the filter also comprises an antenna coupling point and an RX coupling point, to allow the signal to be supplied to the base station receiver, and a TX coupling point, where signals coming from a base station transmitter, for example, are supplied to. The present invention can also be applied in other radio transceivers or radio frequency devices than cellular radio network base stations.

Figure 6:
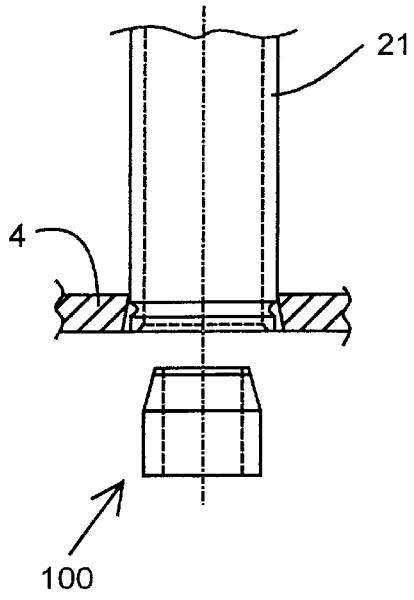
FIG. 6 illustrates a version where the opening in the fastening surface structure is cylindrical.

FIG. 6 illustrates a version where the opening provided for the inner conductor in the fastening surface structure is cylindrical, i.e. the diameter of the opening is equal in the entire area of the opening. The version in question is particularly well applicable if the fastening surface structure is thin, for example less than 2 mm.

Figure 1:
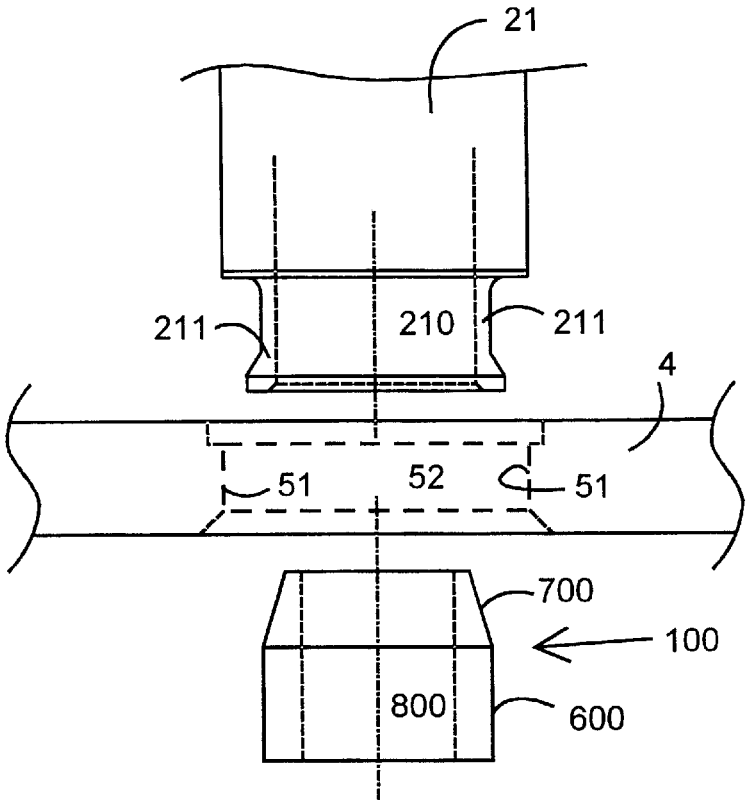

With reference to FIGS. 1 to 3 and to FIG. 7, FIG. 7 shows an expander 100 which is detachably fastened to the end of the inner conductor 21. The inner conductor and the expander 100 would thus first compose an integral piece, such as a machining piece. The structure shown in FIG. 7 is used by placing the inner conductor 21, together with the expander 100 fastened thereto, to the opening 52 in the fastening surface 4 so that at least the inner space 210 of the inner conductor which is in the immediate vicinity of the expander 100 is inside the opening 52. Then a work phase takes place, such as a strike directed to the common longitudinal direction of the expander and the inner conductor, the expander 100 being thereby first detached from the inner conductor 21 as a separate piece, but, since the striking motion still continues, the expander 100 enters further into the inner space 210 of the inner conductor 21, thus causing a pressure to the wall 211 of the inner conductor 21 and from there on to the edge 51 of the opening 52 in the fastening surface structure.

The inner conductor 21 of the preferred embodiment of the invention is annealed metal, preferably steel. The fastening surface structure 4 is preferably made of aluminium, and the expander 100 preferably of brass.

Although the invention is described above with reference to examples shown in the fastened drawings, it is apparent that the invention is not restricted to them, but can vary in many ways within the inventive idea disclosed in the fastened claims.

What is claimed is:

1. An arrangement for fastening an inner conductor of a resonator structure, the arrangement comprising:

a fastening surface structure comprising an edge of an opening and an opening defined by the edge of the opening, the opening being formed through the fastening surface structure; and an inner conductor of a resonator structure at the opening formed through the fastening surface structure, the inner conductor comprising an inner space at least in the portion facing the fastening surface structure, which inner space is defined by the wall of the inner conductor, the wall extending into the opening formed through the fastening surface structure, wherein the fastening arrangement comprises an expander, springy in the radial direction, which is brought and thereby fastened in place into the inner space of the inner conductor placed into the opening formed through the fastening structure, the expander being used for pressing the inner conductor wall surrounding the inner space of the inner conductor in a radial direction against the edge of the opening formed through the fastening structure at least on the portion of the opening area where the wall surrounding the inner space of the inner conductor coincides with the edge of the opening formed through the fastening surface structure.

2. A fastening arrangement according to claim 1, wherein the diameter of the expander is 3 to 15% greater than the diameter of the inner space of the inner conductor.

3. A fastening arrangement according to claim 2, wherein the diameter of the expander is at least 0.3 mm greater than the diameter of the inner space of the inner conductor.

4. A fastening arrangement according to claim 1, wherein when brought in place, the expander forms a deformation area on a section of the joint between the wall surrounding the inner space of the inner conductor and the edge of the opening in the fastening surface structure, the section being on the same side of the fastening surface in the fastening arrangement as the inner conductor.

5. An arrangement for fastening an inner conductor of a resonator structure, the arrangement comprising:

a fastening surface structure comprising an edge of an opening and an opening defined by the edge of the opening, the opening being formed through the fastening surface structure; and an inner conductor of a resonator structure at the opening formed through the fastening surface structure, the inner conductor comprising an inner space at least in the portion facing the fastening surface structure, which inner space is defined by the wall of the inner conductor, the wall extending into the opening formed through the fastening surface structure, wherein the fastening arrangement comprises an expander, springy in the radial direction, which is brought and thereby fastened in place into the inner space of the inner conductor placed into the opening formed through the fastening structure, the expander being used for pressing the inner conductor wall surrounding the inner space of the inner conductor in a radial direction against the edge of the opening formed through the fastening structure at least on the portion of the opening area where the wall surrounding the inner space of the inner conductor coincides with the edge of the opening formed through the fastening surface structure, wherein to allow the tip of the expander to be more easily inserted into the inner space of the inner conductor, the outer surface of the expander is provided with a guide bevel at least the tip of which is narrower than the diameter of the inner space of the inner conductor, wherein the outer surface of the expander is provided with a narrowing bevel, and wherein the slope of the narrowing bevel with regard to the longitudinal direction of the expander is smaller than the slope of the guide bevel.

6. A fastening arrangement according to claim 5, wherein the slope of the narrowing bevel is selected to be between 0.5 and 5 degrees.

7. A fastening arrangement according to claim 6, wherein the slope of the guide bevel is selected to be between 5 and 45 degrees.

8. A fastening arrangement according to claim 5, wherein the slope of the guide bevel is selected to be between 5 and 45 degrees.

9. An arrangement for fastening an inner conductor of a resonator structure, the arrangement comprising:

a fastening surface structure comprising an edge of an opening and an opening defined by the edge of the opening, the opening being formed through the fastening surface structure; and an inner conductor of a resonator structure at the opening formed through the fastening surface structure, the inner conductor comprising an inner space at least in the portion facing the fastening surface structure, which inner space is defined by the wall of the inner conductor, the wall extending into the opening formed through the fastening surface structure, wherein the fastening arrangement comprises an expander, springy in the radial direction, which is brought and thereby fastened in place into the inner space of the inner conductor placed into the opening formed through the fastening structure, the expander being used for pressing the inner conductor wall surrounding the inner space of the inner conductor in a radial direction against the edge of the opening formed through the fastening structure at least on the portion of the opening area where the wall surrounding the inner space of the inner conductor coincides with the edge of the opening formed through the fastening surface structure, and wherein to make the expander springy in the radial direction, the expander comprises an annular wall and a longitudinal through hole defined by the annular wall.

10. An arrangement for fastening an inner conductor of a resonator structure, the arrangement comprising:

a fastening surface structure comprising an edge of an opening and an opening defined by the edge of the opening, the opening being formed through the fastening surface structure; and an inner conductor of a resonator structure at the opening formed through the fastening surface structure, the inner conductor comprising an inner space at least in the portion facing the fastening surface structure, which inner space is defined by the wall of the inner conductor, the wall extending into the opening formed through the fastening surface structure, wherein the fastening arrangement comprises an expander, springy in the radial direction, which is brought and thereby fastened in place into the inner space of the inner conductor placed into the opening formed through the fastening structure, the expander being used for pressing the inner conductor wall surrounding the inner space of the inner conductor in a radial direction against the edge of the opening formed through the fastening structure at least on the portion of the opening area where the wall surrounding the inner space of the inner conductor coincides with the edge of the opening formed through the fastening surface structure, and wherein to make the expander springy in the radial direction, the expander comprises an annular wall and an inner space defined by the annular wall.

* * * * *